US007580052B2

(12) United States Patent
Oohara et al.

(10) Patent No.: US 7,580,052 B2
(45) Date of Patent: Aug. 25, 2009

(54) THERMAL HEAD DRIVE CIRCUIT AND PRINTER USING THE SAME

(75) Inventors: Tomomitsu Oohara, Atsugi (JP); Yukihiro Terada, Atsugi (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 5 days.

(21) Appl. No.: 12/028,914

(22) Filed: Feb. 11, 2008

(65) Prior Publication Data

US 2008/0204540 A1 Aug. 28, 2008

(30) Foreign Application Priority Data

Feb. 23, 2007 (JP) ..... 2007-043679

(51) Int. Cl.
*B41J 2/355* (2006.01)

(52) U.S. Cl. ..... 347/211

(58) Field of Classification Search ..... 347/211, 347/180, 181, 182; 400/120.05, 120.06
See application file for complete search history.

(56) References Cited

U.S. PATENT DOCUMENTS

2002/0109739 A1* 8/2002 Edelen et al. ..... 347/12

FOREIGN PATENT DOCUMENTS

JP 63-022668 * 1/1988
JP 2000-246938 9/2000

OTHER PUBLICATIONS

Computer-generated translation of JP 2000-246938, published on Sep. 2000, cited in the IDS filed Mar. 4, 2008.*

* cited by examiner

*Primary Examiner*—Huan H Tran
(74) *Attorney, Agent, or Firm*—Ladas & Parry LLP

(57) ABSTRACT

A thermal head drive circuit drives M number of thermal heads for printing one line and includes a delay unit that applies different time delays to M bits of print data to be supplied to the corresponding M thermal heads. The higher order the odd number thermal heads of the M thermal heads are, the greater are the time delays applied to the corresponding bits of the print data, while the higher order the even number thermal heads of the M thermal heads are, the less are the time delays applied to the corresponding bits of the print data.

4 Claims, 9 Drawing Sheets

FIG.4

| TERMINAL NUMBER | 1st GROUP OUTPUT ORDER | |
|---|---|---|
| $31_1$ | 1 | |
| $31_2$ | | 144 |
| $31_3$ | 3 | |
| $31_4$ | | 142 |
| $31_5$ | 5 | |
| • | | 140 |
| • | 7 | |
| • | | 138 |
| • | 9 | |
| • | | 136 |
| • | • | • |
| • | • | • |
| • | • | • |
| • | • | • |
| $31_{141}$ | 141 | |
| $31_{142}$ | | 4 |
| $31_{143}$ | 143 | |
| $31_{144}$ | | 2 |

FIG.5

| TERMINAL NUMBER | 1st GROUP OUTPUT ORDER | | 2nd GROUP OUTPUT ORDER | |
|---|---|---|---|---|
| $31_1$ | 1 | | | |
| $31_2$ | | 72 | | |
| $31_3$ | 3 | | | |
| | | 70 | | |
| • | 5 | | | |
| • | | 68 | | |
| • | 7 | | | |
| • | | 66 | | |
| • | 9 | | | |
| • | | 64 | | |
| • | • | • | | |
| • | • | • | | |
| • | • | • | | |
| • | • | • | | |
| | 69 | | | |
| $31_{70}$ | | 4 | | |
| $31_{71}$ | 71 | | | |
| $31_{72}$ | | 2 | | |
| $31_{73}$ | | | 73 | |
| $31_{74}$ | | | | 144 |
| | | | 75 | |
| • | | | | 142 |
| • | | | 77 | |
| • | | | | 140 |
| • | | | 79 | |
| • | | | | 138 |
| • | | | 81 | |
| • | | | | |
| • | | | • | • |
| • | | | • | • |
| • | | | • | • |
| • | | | • | • |
| • | | | | |
| | | | 141 | |
| | | | | 76 |
| $31_{143}$ | | | 143 | |
| $31_{144}$ | | | | 74 |

FIG.6

| TERMINAL NUMBER | 1st GROUP OUTPUT ORDER | | 2nd GROUP OUTPUT ORDER | | 3rd GROUP OUTPUT ORDER | |
|---|---|---|---|---|---|---|
| $31_1$ | 1 | | | | | |
| $31_2$ | | 48 | | | | |
| | 3 | | | | | |
| | | 46 | | | | |
| | 5 | | | | | |
| | | 44 | | | | |
| | 7 | | | | | |
| | | 42 | | | | |
| | 9 | | | | | |
| | | 40 | | | | |
| | ⋮ | ⋮ | | | | |
| | 45 | | | | | |
| | | 4 | | | | |
| $31_{47}$ | 47 | | | | | |
| $31_{48}$ | | 2 | | | | |
| $31_{49}$ | | | 49 | | | |
| $31_{50}$ | | | | 96 | | |
| | | | 51 | | | |
| | | | | 94 | | |
| | | | 53 | | | |
| | | | | 92 | | |
| | | | 55 | | | |
| | | | | 90 | | |
| | | | 57 | | | |
| | | | | 88 | | |
| | | | ⋮ | ⋮ | | |
| | | | 93 | | | |
| | | | | 52 | | |
| $31_{95}$ | | | 95 | | | |
| $31_{96}$ | | | | 50 | | |
| $31_{97}$ | | | | | 97 | |
| $31_{98}$ | | | | | | 144 |
| | | | | | 99 | |
| | | | | | | 142 |
| | | | | | 101 | |
| | | | | | | 140 |
| | | | | | 103 | |
| | | | | | | 138 |
| | | | | | 105 | |
| | | | | | | 136 |
| | | | | | ⋮ | ⋮ |
| | | | | | 141 | |
| | | | | | | 100 |
| $31_{143}$ | | | | | 143 | |
| $31_{144}$ | | | | | | 98 |

THERMAL HEAD DRIVE CIRCUIT AND PRINTER USING THE SAME

BACKGROUND OF THE INVENTION

1. Field of the Invention

The present invention generally relates to a thermal head drive circuit and a printer using the same, and particularly relates to a thermal head drive circuit that drives plural thermal heads according to print data in a parallel form and a printer using the same.

2. Description of the Related Art

As one way of performing printing on thermal paper by melting the dye, linearly-arranged thermal heads are used that generate heat upon application of electric current from corresponding drive circuits.

FIG. 8 is a circuit diagram of a related-art thermal head drive circuit 1. With reference to FIG. 8, the thermal head drive circuit 1 is a semiconductor IC that includes a serial/parallel conversion unit 2, a delay latch unit 3, and an output unit 4.

Print data are input in serial fashion from an input terminal 5 to the serial/parallel conversion unit 2. The serial/parallel conversion unit 2 converts the print data according to a clock CLK, which is input from an input terminal 6, to output the print data in an n-bit parallel fashion. The output bits of the print data are supplied to corresponding AND circuits $\mathbf{7}_1$-$\mathbf{7}_{2N}$ of the delay latch unit 3.

A latch signal with a value of "1" is input from an input terminal 8 to the delay latch unit 3 in synchronization with the completion of the serial-parallel conversion of the print data. The latch signal with the value 1 is sequentially delayed by serially-connected delay elements $\mathbf{9}_1$-$\mathbf{9}_{2N-1}$. The latch signal from the input terminal 8 and the delayed latch signals from the delay elements $\mathbf{9}_1$-$\mathbf{9}_{2N-1}$ are supplied to the AND circuits $\mathbf{7}_1$-$\mathbf{7}_{2N}$ of the delay latch unit 3, respectively. In response to the latch signals with the value 1 supplied from the input terminal 8 and the delay elements $\mathbf{9}_1$-$\mathbf{9}_{2N-1}$, the AND circuits $\mathbf{7}_1$-$\mathbf{7}_{2N}$ latch the corresponding bits of the print data and supply the latched bits of the print data to output FETs (field-effect transistors) $\mathbf{10}_1$-$\mathbf{10}_{2N}$ of the output unit 4, respectively.

The output FETs $\mathbf{10}_1$-$\mathbf{10}_{2N}$ have sources connected to ground and drains connected to output terminals $\mathbf{11}_1$-$\mathbf{11}_{2N}$, respectively. Thermal heads $\mathbf{12}_1$-$\mathbf{12}_{2N}$ are connected at first ends to the output terminals $\mathbf{11}_1$-$\mathbf{11}_{2N}$, respectively, as loads, and at the other ends to a power source 13. The thermal heads $\mathbf{12}_1$-$\mathbf{12}_{2N}$ are aligned in a line on a thermal head substrate 14.

When the output FETs $\mathbf{10}_1$-$\mathbf{10}_{2N}$ are turned ON according to the corresponding bits of the print data, electric current is applied to the thermal heads $\mathbf{12}_1$-$\mathbf{12}_{2N}$ corresponding to the turned-ON output FETs $\mathbf{10}_1$-$\mathbf{10}_{2N}$. Thus, the thermal heads $\mathbf{12}_1$-$\mathbf{12}_{2N}$ generate heat to perform printing on thermal paper.

Japanese Patent Laid-Open Publication No. 2000-246938 discloses a recording head driving device that includes plural groups of thermal head driving circuits. A delay circuit for delaying a strobe signal is disposed upstream of each of a second and subsequent groups of the driving circuits.

In a printer, plural pairs of the thermal head drive circuit 1 and the thermal head substrate 14 of FIG. 8 are disposed adjacent to one another such that the thermal heads of the thermal head substrates 14 are aligned in a line.

In this printer, because each thermal head drive circuit 1 outputs bits of the print data in the order from the output terminal $\mathbf{11}_1$ to the output terminal $\mathbf{11}_{2N}$, heat is transferred across the corresponding thermal head substrate 14 from the thermal head $\mathbf{12}_1$ that first generates heat toward the thermal head $\mathbf{12}_{2N}$ that last generates heat. This results in a temperature distribution as shown in FIG. 9 in the thermal head substrates 14 of the printer, in which the temperature gradient is discontinuous at the boundaries between the adjacent thermal head substrates 14, causing color irregularities in the printed result.

SUMMARY OF THE INVENTION

In view of the foregoing, the present invention is directed to provide a thermal head drive circuit that produces a flat temperature gradient with respect to the position in a thermal head substrate, thereby reducing color irregularities in the printed result; and a printer using this thermal head drive circuit.

According to an aspect of the present invention, there is provided a thermal head drive circuit that drives M number of thermal heads for printing one line. The thermal head drive circuit includes a delay unit that applies different time delays to M bits of print data to be supplied to the corresponding M thermal heads. The higher order the odd number thermal heads of the M thermal heads are, the greater are the time delays applied to the corresponding bits of the print data, while the higher order the even number thermal heads of the M thermal heads are, the less are the time delays applied to the corresponding bits of the print data. This thermal head drive circuit can produce a flat temperature gradient with respect to the position in a thermal head substrate, thereby reducing color irregularities in the printed result.

It is preferable that the delay unit divide the M thermal heads into plural groups and that, in each of the groups, the higher order the odd number thermal heads are, the greater are the time delays applied to the corresponding bits of the print data, while the higher order the even number thermal heads are, the less are the time delays applied to the corresponding bits of the print data.

It is also preferable that the delay unit include M number of AND circuits that latch the corresponding M bits of the print data; plural first delay elements that are serially connected to one another and are configured to sequentially delay a latch signal to produce sequentially delayed latch signals and supply the delayed latch signals to the corresponding odd number AND circuits of the M AND circuits; and plural second delay elements that are serially connected to one another and are configured to sequentially delay the latch signal to produce sequentially delayed latch signals and supply the delayed latch signals to the corresponding even number AND circuits of the M AND circuits. The M AND circuits latch the corresponding M bits of the print data in response to the corresponding delayed latch signals and supply the latched M bits of the print data to the corresponding M thermal heads.

According to another embodiment of the present invention, there is provided a printer that includes plural of the above-described thermal head drive circuits; and plural sets of M number of thermal heads connected to the corresponding thermal head drive circuits, the thermal heads being aligned in a line.

In one embodiment of the present invention, it is possible to produce a flat temperature gradient with respect to the position in a thermal head substrate, thereby reducing color irregularities in the printed result.

BRIEF DESCRIPTION OF THE DRAWINGS

FIG. 4 is a diagram illustrating grouping and the output order of output terminals according to an embodiment of the present invention;

FIG. 5 is a diagram illustrating grouping and the output order of output terminals according to a first modified embodiment of the present invention;

FIG. 6 is a diagram illustrating grouping and the output order of output terminals according to a second modified embodiment of the present invention;

DETAILED DESCRIPTION OF THE PREFERRED EMBODIMENT

An Embodiment of a Thermal Head Drive Circuit

Figure 1:
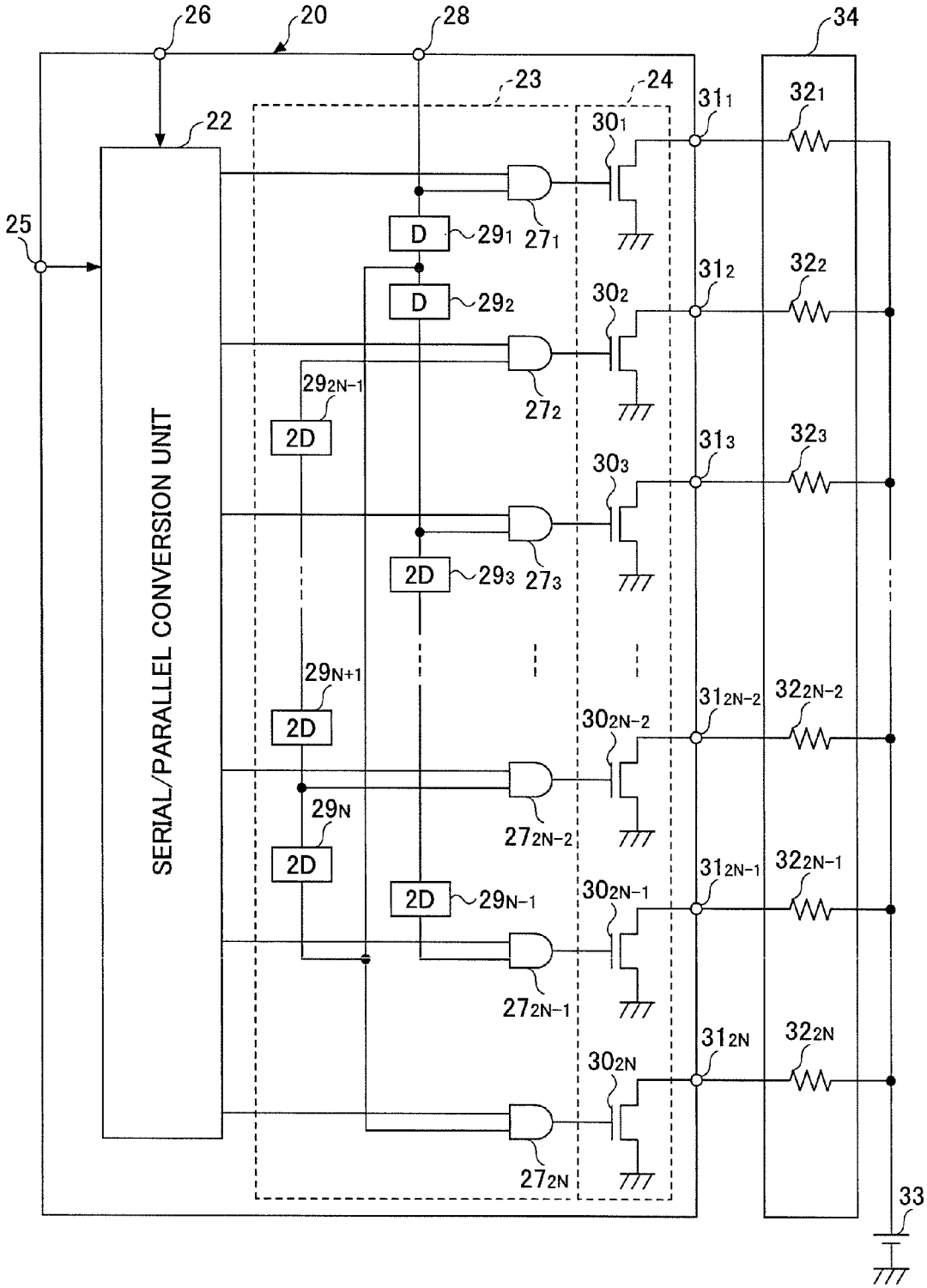
FIG. 1 is a circuit diagram of a thermal head drive circuit according to an embodiment of the present invention.

FIG. 1 is a circuit diagram showing the configuration of a thermal head drive circuit 20 according to an embodiment of the present invention. With reference to FIG. 1, the thermal head drive circuit 20 is a semiconductor IC that includes a serial/parallel conversion unit 22, a delay latch unit 23, and an output unit 24. Print data are input in serial fashion from an input terminal 25 to the serial/parallel conversion unit 22.

The serial/parallel conversion unit 22 converts the print data according to a clock CLK, which is input from an input terminal 26, to output the print data in an M-bit parallel fashion (e.g. M=2N=144). The output bits of the print data are supplied to corresponding AND circuits $\mathbf{27}_1$-$\mathbf{27}_{2N}$ of the delay latch unit 23.

Figure 7:
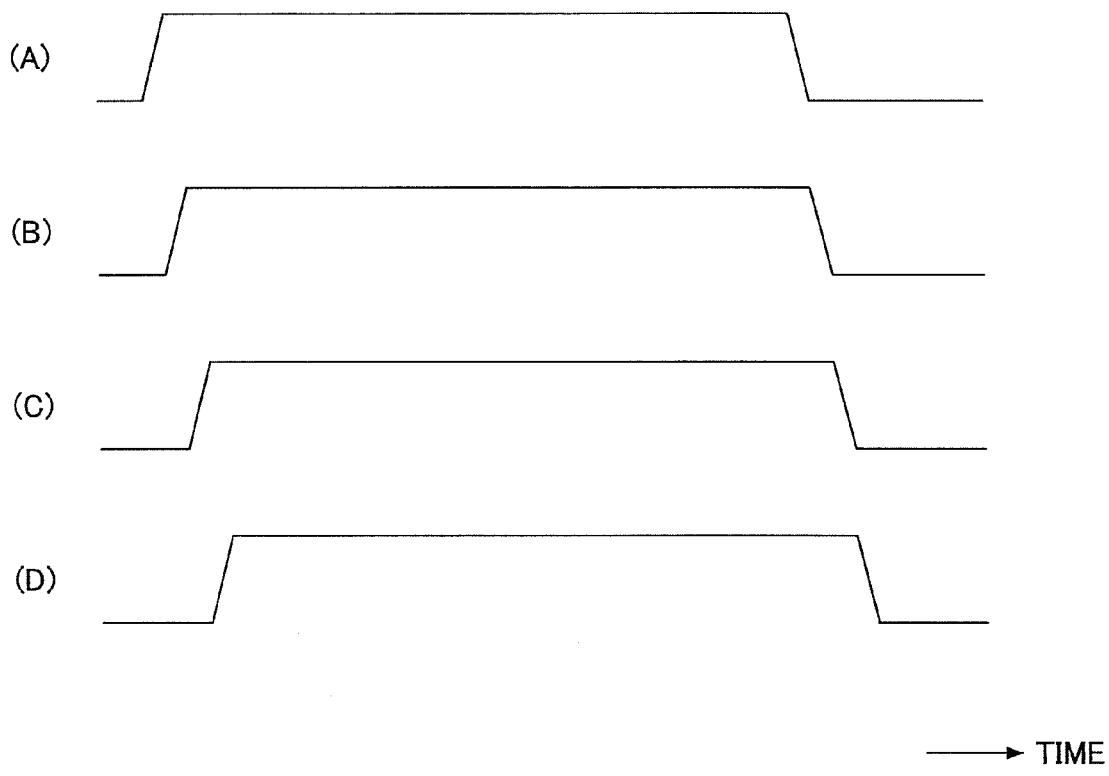
FIG. 7 is a diagram showing waveforms of latch signals supplied to AND circuits.
Figure 8:
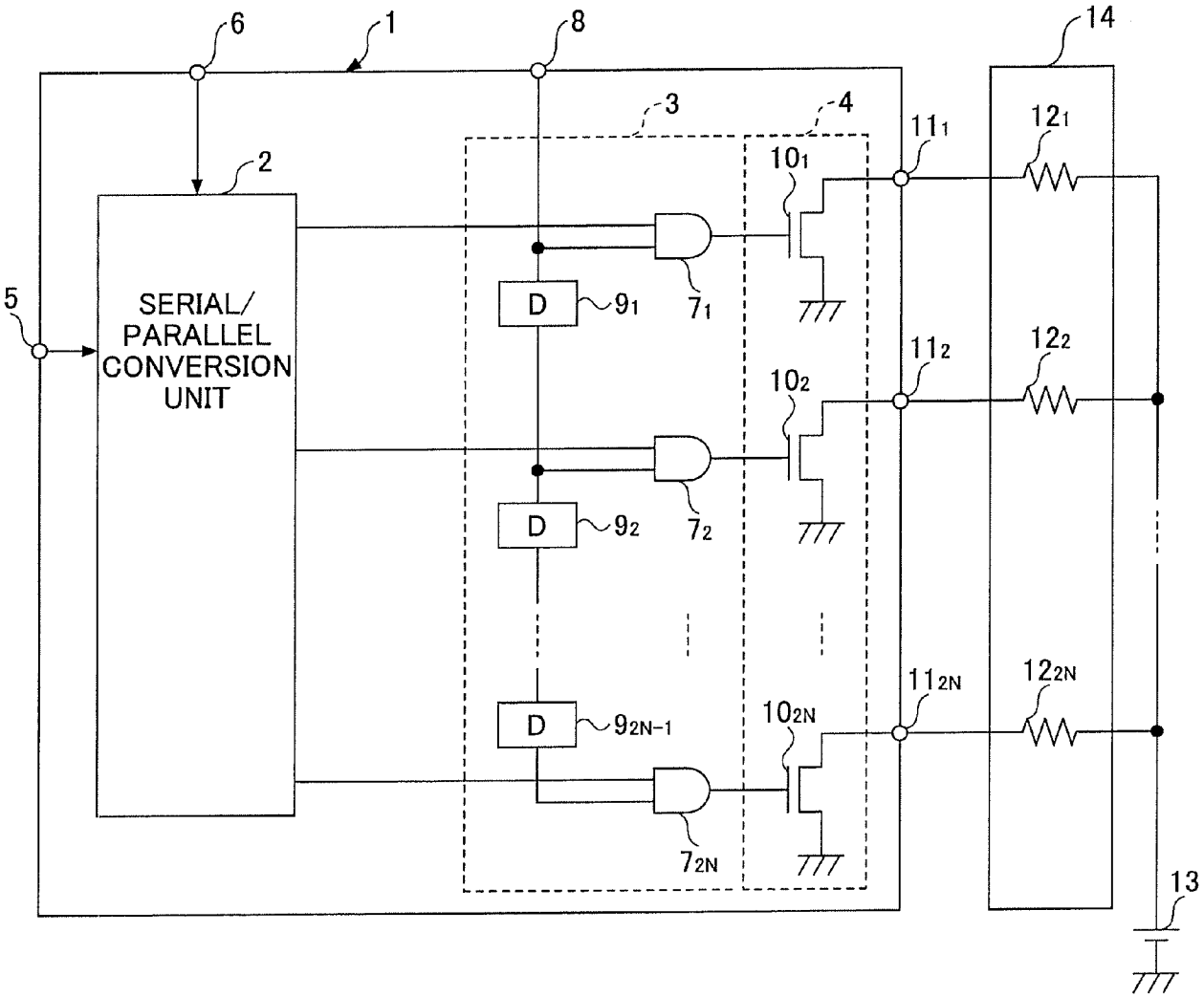
FIG. 8 is a circuit diagram of a thermal head drive circuit according to related art.
Figure 9:
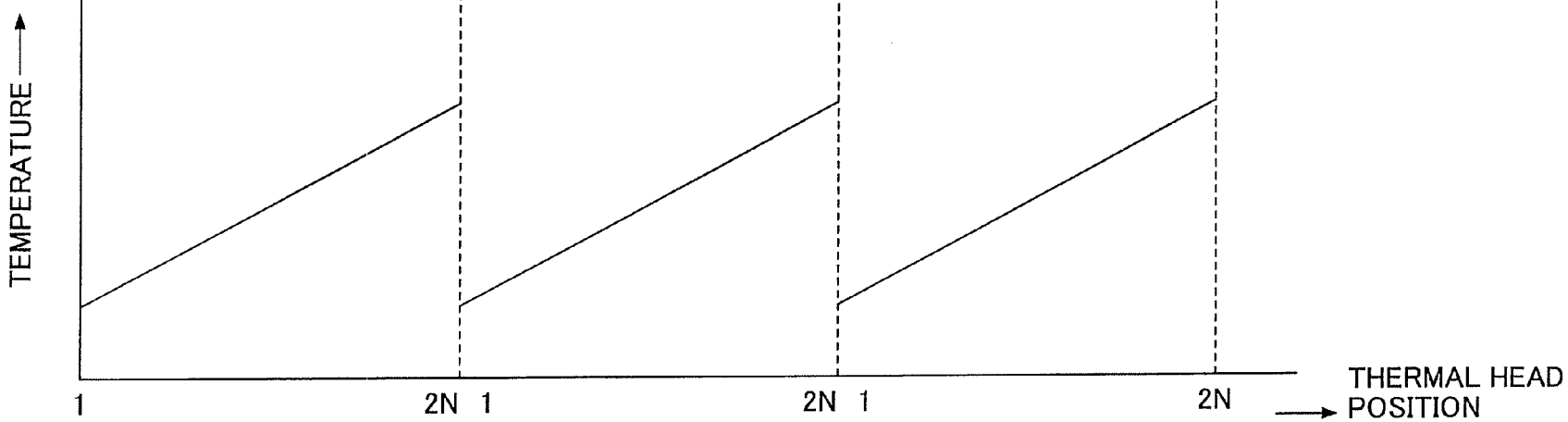
FIG. 9 is a graph showing a temperature distribution in plural thermal head substrates according to related art.

A latch signal with a value of "1" is input from an input terminal 28 to the delay latch unit 23 for a predetermine period of time in synchronization with the completion of the serial-parallel conversion of the print data. The latch signal is delayed by a first delay element $\mathbf{29}_1$ and is split into two paths. The signal in one of the paths is supplied to serially-connected delay elements $\mathbf{29}_2$-$\mathbf{29}_{N-1}$, by which the latch signal is sequentially delayed to produce sequentially delayed latch signals. The sequentially delayed latch signals are supplied to the corresponding odd number AND circuits $\mathbf{27}_3$, $\mathbf{27}_5$, . . . , and $\mathbf{27}_{2N-1}$. The signal in the other path is supplied to the 2N th AND circuit $\mathbf{27}_{2N}$, and to sequentially-connected delay elements $\mathbf{29}_N$-$\mathbf{29}_{2N-1}$, by which the latch signal is sequentially delayed to produce sequentially delayed latch signals. The sequentially delayed latch signals are supplied to the corresponding even number AND circuits $\mathbf{27}_{2N-2}$, $\mathbf{27}_{2N-4}$, . . . , and $\mathbf{27}_2$. When the amount of delay applied by each of the delay elements $\mathbf{29}_1$, $\mathbf{29}_2$ is D (D is, for example, in a range from several tens to several hundreds of nanoseconds), the amount of delay applied by each of the delay elements $\mathbf{29}_3$-$\mathbf{29}_{2N-1}$ is 2D. The waveforms of the latch signals supplied to the AND circuits $\mathbf{27}_1$-$\mathbf{27}_4$ are shown in (A)-(D) of FIG. 7, respectively.

In response to the latch signals with the value 1, the AND circuits $\mathbf{27}_1$-$\mathbf{27}_{2N}$ latch the corresponding bits of the print data and supply the latched bits of the print data to output FETs $\mathbf{30}_1$-$\mathbf{30}_{2N}$, respectively. The output FETs $\mathbf{30}_1$-$\mathbf{30}_{2N}$ are n-channel MOS-FETs and are aligned in a line.

The output FETs $\mathbf{30}_1$-$\mathbf{30}_{2N}$ have sources connected to ground and drains connected to output terminals $\mathbf{31}_1$-$\mathbf{31}_{2N}$, respectively, which output terminals $\mathbf{31}_1$-$\mathbf{31}_{2N}$ are aligned in a line. Thermal heads $\mathbf{32}_1$-$\mathbf{32}_{2N}$ are connected at first ends to the output terminals $\mathbf{31}_1$-$\mathbf{31}_{2N}$, respectively, as loads, and at the other ends to a power source 33. The M thermal heads $\mathbf{32}_1$-$\mathbf{32}_{2N}$ are aligned in a line on a thermal head substrate 34.

The output FETs $\mathbf{30}_1$-$\mathbf{30}_{2N}$ are turned ON if the corresponding bits of the print data have a value of, e.g., 1. Electric current is applied to the thermal heads $\mathbf{32}_1$-$\mathbf{32}_{2N}$ corresponding to the turned-ON output FETs $\mathbf{30}_1$-$\mathbf{30}_{2N}$. Thus, the thermal heads $\mathbf{32}_1$-$\mathbf{32}_{2N}$ generate heat to perform printing on thermal paper.

In this embodiment, the thermal head drive circuit 20 is configured such that the odd number output terminals $\mathbf{31}_1$, $\mathbf{31}_3$, . . . , and $\mathbf{31}_{2N-1}$ output the corresponding bits of the print data in the order from the output terminal $\mathbf{31}_1$ to the output terminal $\mathbf{31}_{2N-1}$ while even number output terminals $\mathbf{31}_2$, $\mathbf{31}_4$, . . . , $\mathbf{31}_{2N}$ output the corresponding bits of the print data in the order from the output terminals $\mathbf{31}_{2N}$ to the output terminal $\mathbf{31}_2$.

Therefore, the odd number thermal heads $\mathbf{32}_1$, $\mathbf{32}_3$, . . . , and $\mathbf{32}_{2N-1}$ cause the heat to transfer across the thermal head substrate 34 from the thermal head $\mathbf{32}_1$ that first generates heat toward the thermal head $\mathbf{32}_{2N-1}$ that last generates heat. Meanwhile, the even number thermal heads $\mathbf{32}_2$, $\mathbf{32}_4$, . . . , and $\mathbf{32}_{2N}$ cause the heat to transfer across the thermal head substrate 34 from the thermal head $\mathbf{32}_{2N}$ that first generates heat toward the thermal head $\mathbf{32}_2$ that last generates heat.

Figure 2:
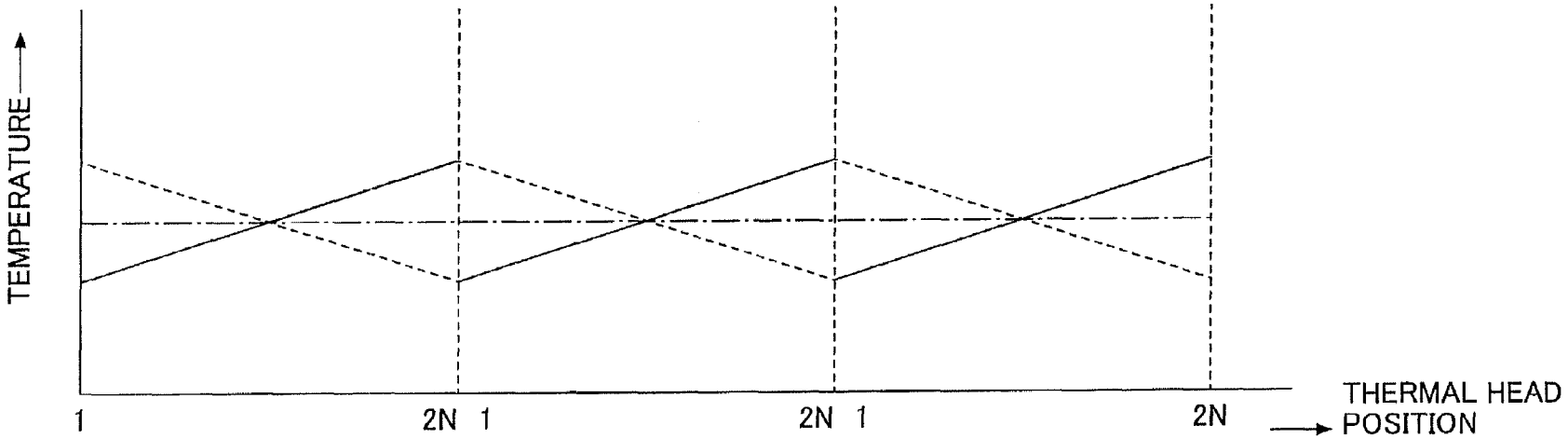
FIG. 2 is a graph showing a temperature distribution in plural thermal head substrates.

Referring to FIG. 2, a temperature distribution in plural of the thermal head substrates 34 is shown with respect to thermal head positions (1–2N) of each of the thermal head substrates 34. A temperature distribution, in each of the thermal head substrates 34, due to the odd number thermal heads $\mathbf{32}_1$, $\mathbf{32}_3$, . . . , and $\mathbf{32}_{2N-1}$ is indicated by a broken line, while a temperature distribution due to the even number thermal heads $\mathbf{32}_2$, $\mathbf{32}_4$, . . . , and $\mathbf{32}_{2N}$ of each of the thermal head substrates 34 is indicated by a solid line. The temperature distribution due to the odd number thermal heads $\mathbf{32}_1$, $\mathbf{32}_3$, . . . , and $\mathbf{32}_{2N-1}$ and the temperature distribution due to the even number thermal heads $\mathbf{32}_2$, $\mathbf{32}_4$, . . . , and $\mathbf{32}_{2N}$ have opposite gradients, which offset one another, making the temperature distribution due to all the thermal heads $\mathbf{32}_1$-$\mathbf{32}_{2N}$ substantially flat as indicated by a single-dot chain line in FIG. 2.

In the above embodiment, the higher order the odd number bits of the 2N-bit parallel print data are, the greater is the amount of delay applied, while the higher order the even number bits are, the less is the amount of delay applied. In an alternative embodiment, the higher order the odd number bits, the less is the amount of delay applied, while the higher order the even number bits are, the greater is the amount of delay applied.

[The Configuration of a Printer]

Figure 3:
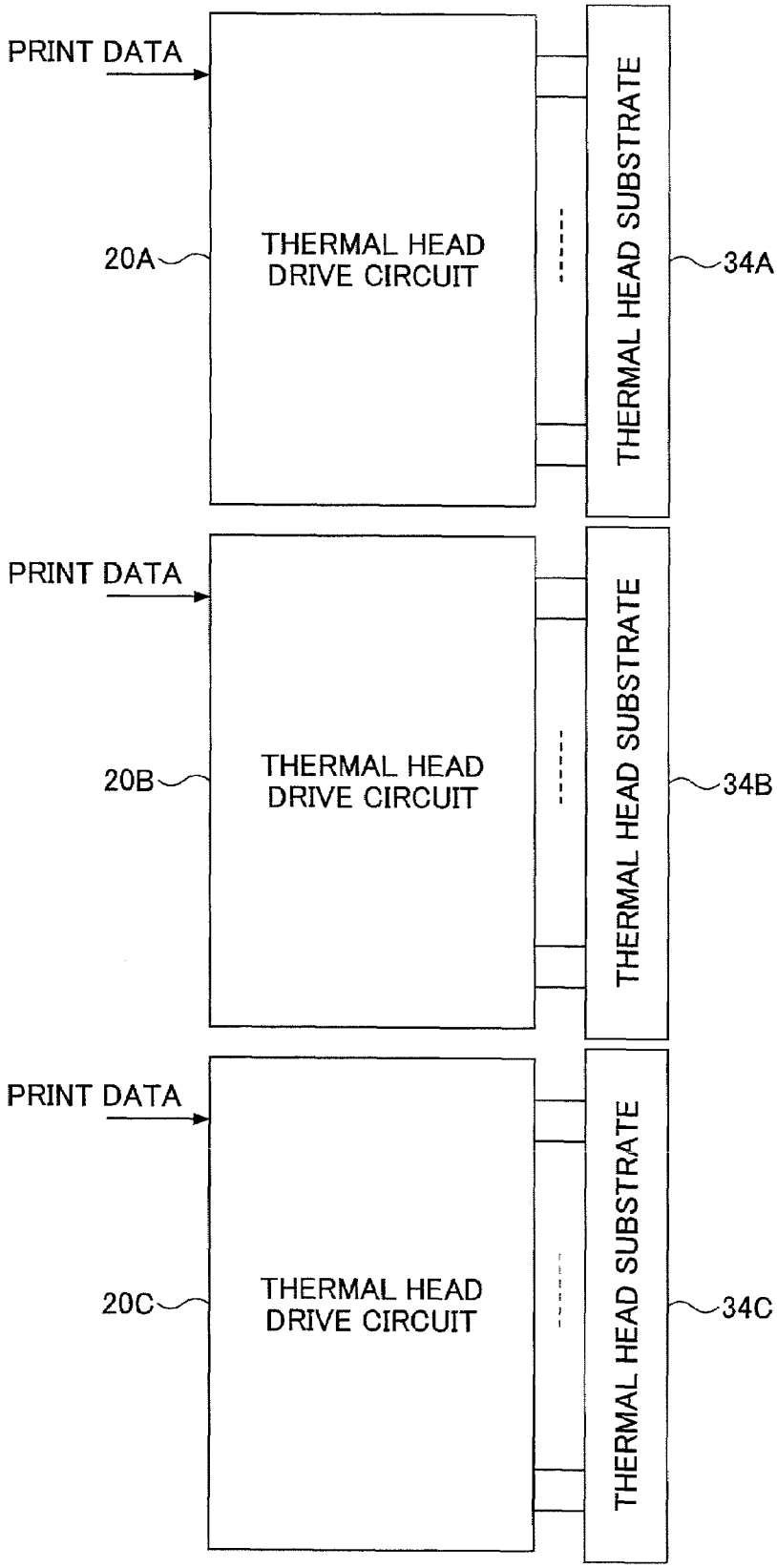
FIG. 3 is a block diagram showing a printer using thermal head drive circuits according to an embodiment of the present invention.

FIG. 3 is a block diagram showing a printer using thermal head drive circuits 20A, 20B, and 20C according to an embodiment of the present invention. Each of the thermal head drive circuits 20A, 20B, and 20C shown in FIG. 3 has the same configuration as the thermal head drive circuit 20 shown in FIG. 1 and is connected to a set of thermal heads $\mathbf{32}_1$-$\mathbf{32}_{2N}$ (not shown) on the corresponding one of thermal head substrates 34 (34A, 34B, and 34C). The thermal head drive circuits 20A, 20B, and 20C are disposed adjacent to one another. Thermal head substrates 34A, 34B, and 34C are disposed such that the sets of thermal heads $\mathbf{32}_1$-$\mathbf{32}_{2N}$ connected to the corresponding thermal head drive circuits 20A, 20B, and 20C are aligned in a line.

The sets of thermal heads $\mathbf{32}_1$-$\mathbf{32}_{2N}$ of the thermal head substrates 34A, 34B, and 34C connected to the corresponding thermal head drive circuits 20A, 20B, and 20C produce a substantially flat temperature distribution as shown by the single-dot chain line of FIG. 2, so that the temperature gradient is substantially continuous at the boundaries between the adjacent thermal head substrates 34, resulting in substantially reducing the color irregularities in the printed result.

Modified Embodiments of a Thermal Head Drive Circuit

With reference to FIG. 4, the thermal head drive circuit 20 of FIG. 1 includes, e.g., output terminals $\mathbf{31}_1$-$\mathbf{31}_{144}$ for 144-bit data, which are treated as one group. As shown in the output order list of FIG. 4, in this group, the odd number output terminals $\mathbf{31}_1$, $\mathbf{31}_3$, . . . , $\mathbf{31}_{143}$ output corresponding bits of the print data in the order from the output terminal $\mathbf{31}_1$ to the output terminal $\mathbf{31}_{143}$, while the even number output terminals $\mathbf{31}_2$, $\mathbf{31}_4$, . . . , $\mathbf{31}_{144}$ output corresponding bits of the print data in the order from the output terminal $\mathbf{31}_{144}$ to the output terminal $\mathbf{31}_2$.

With reference to FIG. 5, in a first modified embodiment of the above embodiment, output terminals $\mathbf{31}_1$-$\mathbf{31}_{144}$ for 144-bit data are divided into two groups, namely, a first group including the output terminals $\mathbf{31}_1$-$\mathbf{31}_{72}$ and a second group including the output terminals $\mathbf{31}_{73}$-$\mathbf{31}_{144}$. As shown in the output order list of FIG. 5, in the first group, the odd number output terminals $\mathbf{31}_1$, $\mathbf{31}_3$, . . . , $\mathbf{31}_{71}$ output corresponding bits of the print data in the order from the output terminal $\mathbf{31}_1$ to the output terminal $\mathbf{31}_{71}$, while the even number output terminals $\mathbf{31}_2$, $\mathbf{31}_4$, . . . , $\mathbf{31}_{72}$ output corresponding bits of the print data in the order from the output terminal $\mathbf{31}_{72}$ to the output terminal $\mathbf{31}_2$. In the second group, the odd number output terminals $\mathbf{31}_{73}$, $\mathbf{31}_{75}$, . . . , $\mathbf{31}_{143}$ output corresponding bits of the print data in the order from the output terminal $\mathbf{31}_{73}$ to the output terminal $\mathbf{31}_{143}$, while the even number output terminals $\mathbf{31}_{74}$, $\mathbf{31}_{76}$, . . . , $\mathbf{31}_{144}$ output corresponding bits of the print data in the order from the output terminal $\mathbf{31}_{144}$ to the output terminal $\mathbf{31}_{74}$.

With reference to FIG. 6, in a second modified embodiment, output terminals $\mathbf{31}_1$-$\mathbf{31}_{144}$ for 144-bit data are divided into three groups, namely, a first group including the output terminals $\mathbf{31}_1$-$\mathbf{31}_{48}$, a second group including the output terminals $\mathbf{31}_{49}$-$\mathbf{31}_{96}$, and a third group including the output terminals $\mathbf{31}_{97}$-$\mathbf{31}_{144}$. As shown in the output order list of FIG. 6, in the first group, the odd number output terminals $\mathbf{31}_1$, $\mathbf{31}_3$, . . . , $\mathbf{31}_{47}$ output corresponding bits of the print data in the order from the output terminal $\mathbf{31}_1$ to the output terminal $\mathbf{31}_{47}$, while the even number output terminals $\mathbf{31}_2$, $\mathbf{31}_4$, . . . , $\mathbf{31}_{48}$ output corresponding bits of the print data in the order from the output terminal $\mathbf{31}_{48}$ to the output terminal $\mathbf{31}_2$. In the second group, the odd number output terminals $\mathbf{31}_{49}$, $\mathbf{31}_{51}$, . . . , $\mathbf{31}_{95}$ output corresponding bits of the print data in the order from the output terminal $\mathbf{31}_{49}$ to the output terminal $\mathbf{31}_{95}$, while the even number output terminals $\mathbf{31}_{50}$, $\mathbf{31}_{52}$, . . . , $\mathbf{31}_{96}$ output corresponding bits of the print data in the order from the output terminal $\mathbf{31}_{96}$ to the output terminal $\mathbf{31}_{50}$. In the third group, the odd number output terminals $\mathbf{31}_{97}$, $\mathbf{31}_{99}$, . . . , $\mathbf{31}_{143}$ output corresponding bits of the print data in the order from the output terminal $\mathbf{31}_{97}$ to the output terminal $\mathbf{31}_{143}$, while the even number output terminals $\mathbf{31}_{98}$, $\mathbf{31}_{100}$, . . . , $\mathbf{31}_{144}$ output corresponding bits of the print data in the order from the output terminal $\mathbf{31}_{144}$ to the output terminal $\mathbf{31}_{98}$.

In the foregoing embodiments, the AND circuits $\mathbf{27}_1$-$\mathbf{27}_{2N}$ are used in order to perform logical AND in positive logic. In the case of performing logical NAND in negative logic, NAND circuits are used in place of the AND circuits $\mathbf{27}_1$-$\mathbf{27}_{2N}$.

The present application is based on Japanese Priority Application No. 2007-043679 filed on Feb. 23, 2007, with the Japanese Patent Office, the entire contents of which are hereby incorporated by reference.

What is claimed is:

1. A thermal head drive circuit that drives M number of thermal heads for printing one line, the thermal head drive circuit comprising:

a delay unit that applies different time delays to M bits of print data to be supplied to the corresponding M thermal heads;

wherein the higher order the odd number thermal heads of the M thermal heads are, the greater are the time delays applied to the corresponding bits of the print data, while the higher order the even number thermal heads of the M thermal heads are, the less are the time delays applied to the corresponding bits of the print data.

2. The thermal head drive circuit as claimed in claim 1, wherein the delay unit divides the M thermal heads into plural groups; and wherein, in each of the groups, the higher order the odd number thermal heads are, the greater are the time delays applied to the corresponding bits of the print data, while the higher order the even number thermal heads are, the less are the time delays applied to the corresponding bits of the print data.

3. The thermal head drive circuit as claimed in claim 1, wherein the delay unit includes M number of AND circuits that latch the corresponding M bits of the print data;

plural first delay elements that are serially connected to one another and are configured to sequentially delay a latch signal to produce sequentially delayed latch signals and supply the delayed latch signals to the corresponding odd number AND circuits of the M AND circuits; and plural second delay elements that are serially connected to one another and are configured to sequentially delay the latch signal to produce sequentially delayed latch signals and supply the delayed latch signals to the corresponding even number AND circuits of the M AND circuits; and wherein the M AND circuits latch the corresponding M bits of the print data in response to the corresponding delayed latch signals and supply the latched M bits of the print data to the corresponding M thermal heads.

4. A printer comprising:

plural of the thermal head drive circuits of claim 1; and plural sets of M number of thermal heads connected to the corresponding thermal head drive circuits, the thermal heads being aligned in a line.

* * * * *